United States Patent [19]

Coldren et al.

[11] 4,214,361

[45] Jul. 29, 1980

[54] METHOD OF MAKING INSULATED ELECTRICAL TERMINATIONS

[75] Inventors: Daniel R. Coldren, Enola; James E. Marley, Dauphin, both of Pa.

[73] Assignee: AMP Incorporated, Harrisburg, Pa.

[21] Appl. No.: 18,551

[22] Filed: Mar. 8, 1979

Related U.S. Application Data

[63] Continuation of Ser. No. 863,567, Dec. 22, 1977, abandoned.

[51] Int. Cl.[2] ..... H01R 43/04

[52] U.S. Cl. ..... 29/863; 29/564.6; 29/882; 29/753; 339/213 T; 339/220 R

[58] Field of Search ..... 29/630 A, 630 R, 451, 29/453, 445, 753, 564.6, 628, 33 S; 339/213 T

[56] References Cited

U.S. PATENT DOCUMENTS

| | | | |
|---|---|---|---|
| 2,963,775 | 12/1960 | Chadwick | 29/630 A |
| 3,774,141 | 11/1973 | Condon | 339/213 T X |
| 4,074,424 | 2/1978 | Deshich et al. | 29/753 |

*Primary Examiner*—Carl E. Hall
*Assistant Examiner*—C. J. Arbes
*Attorney, Agent, or Firm*—Frederick W. Raring

[57] ABSTRACT

Electrical connecting device is intended to be applied to a wire comprises an insulating housing having a wire-receiving end and a cavity extending into the wire-receiving end. A terminal is partially inserted into the cavity so that the crimp portion of the terminal is outside of the cavity and adjacent to the wire-receiving end. After the crimp portion has been crimped onto a wire, the terminal is moved to a fully inserted condition so that the finished termination is completely insulated. The housing and partially inserted terminal are produced as an endless strip which can be fed to a crimping machine.

4 Claims, 7 Drawing Figures

6
5
38
2

34
8
4
55
42
32
5
36
65
61
28

16
26
12
22
10
30
24
18
16
14
4
60
44
4
58

Fig. 4
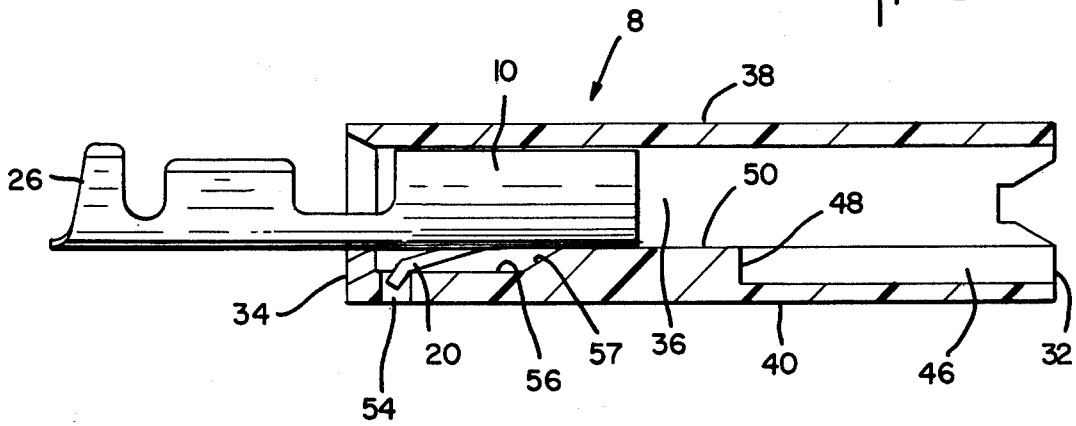
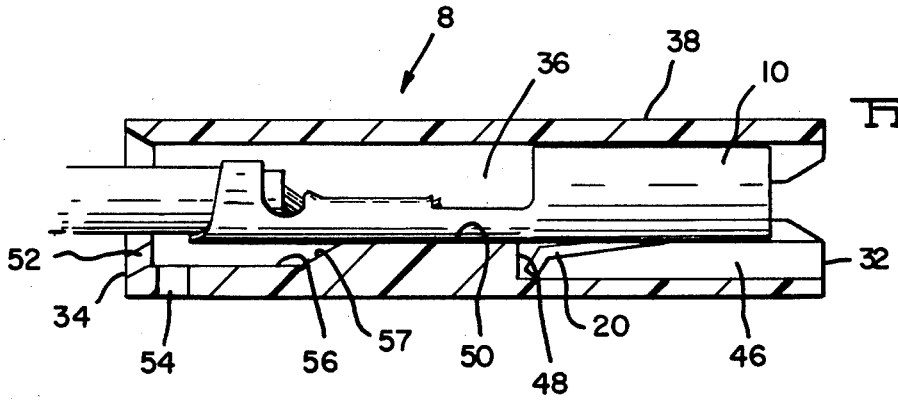
Fig. 5
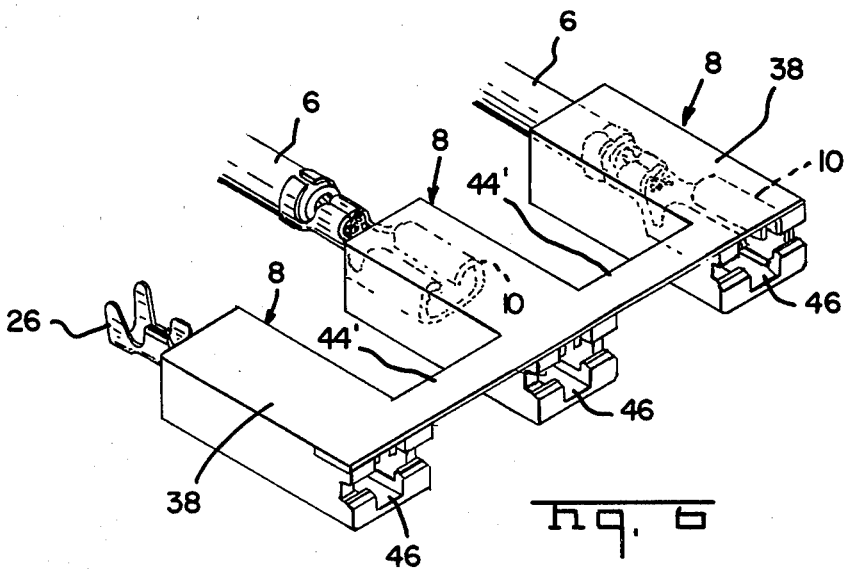
Fig. 6

METHOD OF MAKING INSULATED ELECTRICAL TERMINATIONS

This application is a continuation of application Ser. No. 863,567 filed Dec. 22, 1977 and now abandoned.

BACKGROUND OF THE INVENTION

This invention relates to insulated electrical terminations of the type comprising a terminal on the end of a conductor and an insulating housing which contains the terminal and a portion of a conductor. The principal embodiment of the invention described herein comprises a termination of a type widely used in the appliance and automotive industries which can be mated with a rectangular tab terminal however, it will be apparent that the principles of the invention can be used with a wide variety of types of electrical terminals.

A commonly used type of electrical terminal comprises a receptacle having a web and curled sidewalls extending from the side edges of the web. Terminals of this type are usually secured to the ends of wires by crimping a U-shaped crimp portion of the terminal onto the wire end. It is frequently necessary, for reasons of safety, to provide insulation in surrounding relationship to the terminal and the end portion of the wire, and the provision of such insulation has been accomplished by several different techniques. One common technique is to provide individual plastic housings which are dimensioned to receive terminals so that the terminals, after being crimped onto wires, can be inserted into the housings in a step subsequent to the crimping step. Pre-insulated terminations are also available and are widely used. The terminals for this type of pre-insulated connecting device are pre-inserted into the housings before the crimping step and the insulation, as well as the crimp portion of the terminal, are deformed and crimped during the crimping step.

Under many circumstances it is highly desirable to crimp the terminal onto the wire in a separate step and follow the procedure described above of inserting the terminal into the housing after crimping. A separate crimping step is preferable under some circumstances for the reason that many types of electrical crimps require extremely high crimp force and many plastic housings cannot withstand these very high crimping forces without cracking or other type of failure.

In accordance with the instant invention, the terminals are partially inserted into the housing so that the contact portion of the terminal is contained within the cavity in the housing and the crimp portion of the terminal lies outside of the housing. Stop means or retaining means are provided for retaining the terminal in its partially inserted condition, the retaining means being such that the terminal can be moved to its fully inserted condition after crimping. The housings with the partially inserted terminals assembled thereto are produced as a continuous strip which can be fed to a crimping apparatus thereby to permit rapid application of the terminals to wires by the final user.

It is accordingly an object of the invention to provide an improved electrical termination. A further object is to provide an improved method of producing insulated electrical terminations. A further object is to provide economies in the manufacture of fully insulated electrical terminations on the ends of wires.

These and other objects of the invention are achieved in preferred embodiments which are briefly described in the foregoing abstract, and are described in detail below, and which are shown in the accompanying drawing in which.

Figures 1, 2, 3:
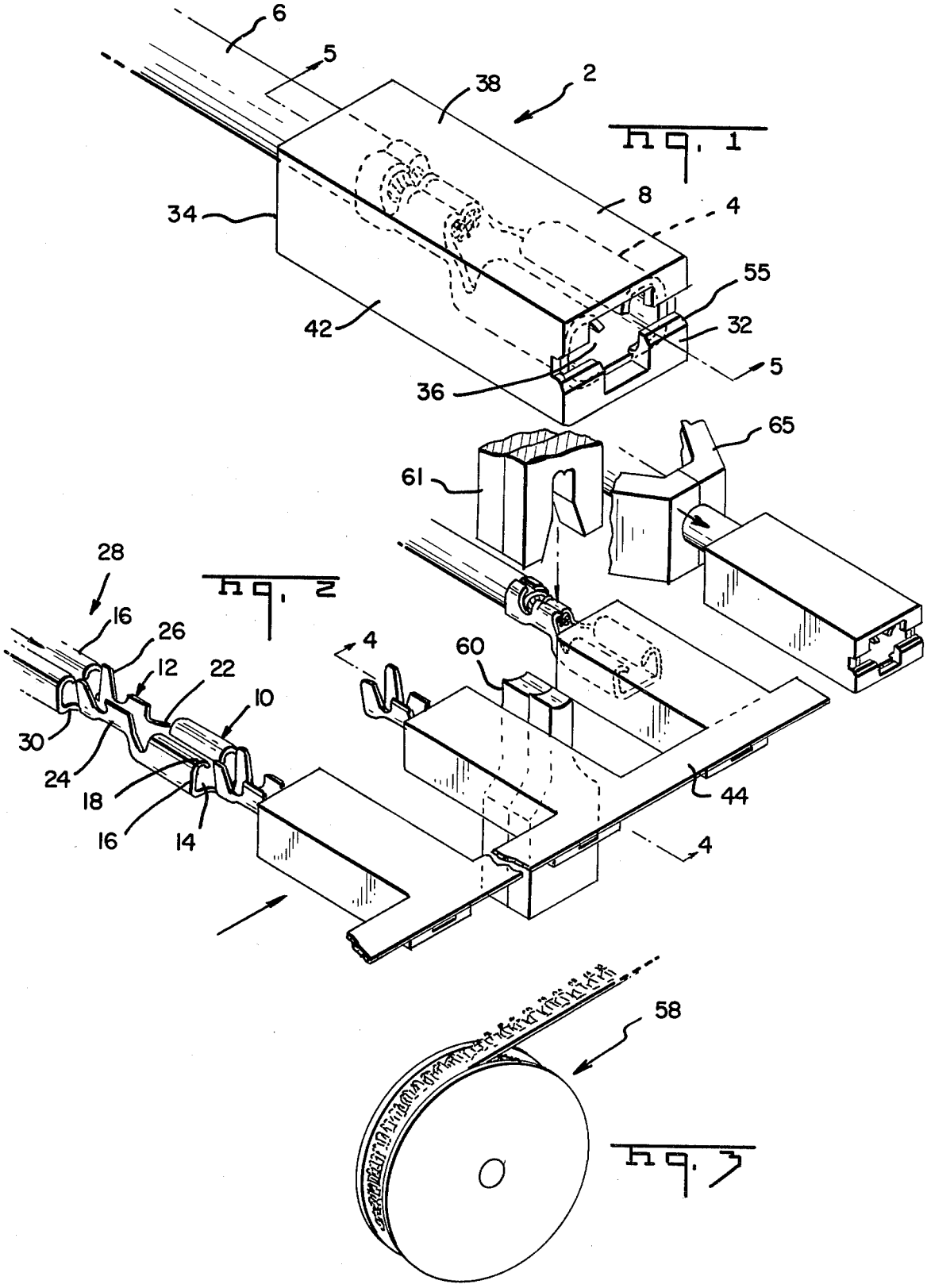
FIG. 1 is a perspective view of an individual electrical termination in accordance with the invention.
FIG. 2 is a perspective view showing the stages of producing a completed termination as shown in FIG. 1.
FIG. 3 is a perspective view of a reel of terminals in accordance with the invention.

FIGS. 4 and 5 are cross-sectional views taken along the lines 4—4 and 5—5 of FIGS. 2 and 1 respectively.

FIG. 6 is a perspective view of a multi-contact electrical connector in accordance with the invention.

Figure 7:
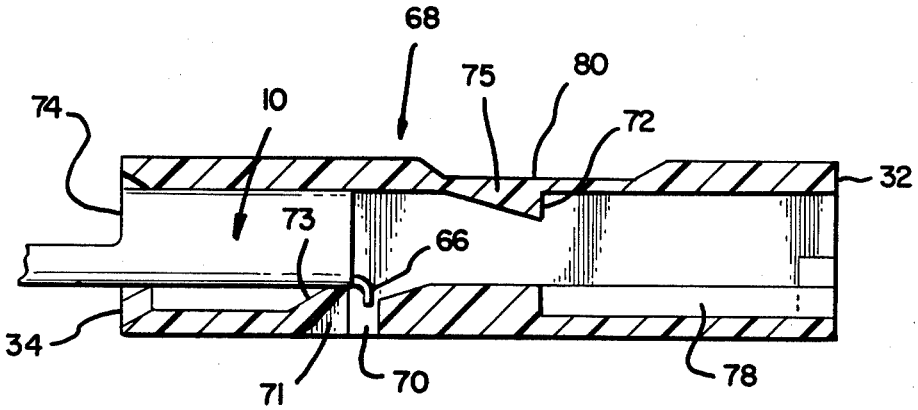

FIG. 7 is a cross-sectional view of an alternative embodiment.

As shown in FIGS. 1 and 5, an electrical termination 2 in accordance with one embodiment of the invention comprises a terminal 4 which is crimped onto one end of a wire 6 and which is contained in an insulating housing 8 of suitable plastic material such as nylon. The terminal 4 is of a common type which is dimensioned to be mated with a complementary tab terminal and comprises a contact portion 10 and a crimp portion 12 which is in alignment with the contact portion. The contact portion has a web 14 from the marginal wide edges of which sidewalls 16 extend. These sidewalls are reversely curled as shown at 18 towards each other and towards the web 14 so that the tab will be received between the edges of the curled sidewalls 18 and the surface of the web. A retention lance 20 (FIG. 4) is struck from the web and extends downwardly and rearwardly towards the crimp portion 12.

The crimp portion 12 is connected to the receptacle portion 10 by a transition section 22 and comprises a generally U-shaped wire crimp portion 24 and a U-shaped insulation crimp portion 26. The wire crimp portion is dimensioned to be crimped onto the conducting strands of the wire 6 and the insulation crimp portion is adapted to be crimped onto the insulation as shown in FIG. 2.

Terminals of the type shown at 4 are manufactured by stamping and forming methods and they are intended for use in the practice of the instant invention, they are advantageously manufactured as end-to-end strip as shown in FIG. 2 rather than ladder strip form. The manufacture of terminals in end-to-end strip is usually more convenient and economical of materials than the manufacture of ladder strip terminals and end-to-end strip is advantageous in the practice of the instant invention for reasons which will be explained below.

The insulating housing 8 has rectangular external surfaces and has a cavity 36 extending therethrough from its rearward or conductor-receiving end 34 to its mating end 32. The cavity 36 has a groove or recess 46 in its floor 50 (see FIG. 4) extending rearwardly from the mating face 32 so that a shoulder 48 is provided intermediate the ends of the cavity which is directed towards the mating face 32. An opening 54 is provided in the floor 50 of the cavity adjacent to the end 34 of the housing. This opening extends into a groove 56 which extends forwardly to an inclined ramp 57 as shown in FIG. 4.

Housings of the type shown are advantageously produced in the form of an endless strip by a molding process of the class described in Application Ser. No. 734,708 filed Oct. 21, 1976 abandoned. The adjacent housings of the strip are integral with, and extend from, a continuous carrier strip 44 the upper surface of which is coplanar with the top surface 38 of the housings. The mating face 32 of each housing is provided with lead-in surfaces as shown at 55 to assist in guiding a complementary tab terminal into the housing and into engagement with the receptacle terminal contained therein.

As shown in FIG. 2, a strip containing partially inserted terminals is manufactured by feeding continous housing strip and feeding a strip 28 of end-to-end connected terminals to an assembly station. The leading terminal 4 of the terminal strip 28 is severed at the assembly station and the connecting neck portion 30 is removed as the terminal is inserted into the housing 8 located at this station. The terminal is inserted partially until the end of the lance 20 snaps into the opening 54 of the housing. This opening, in cooperation with the lance, thus constitutes a first retention means which is capable of holding the terminal in the housing during subsequent handling and shipment. After assembly of the terminals to the housings, the strip is wound on a reel 58 and transported to the site at which the terminals are applied to the ends of wires.

As also shown in FIG. 2, individual housings can be applied to the ends of wires by feeding the strip to applicator tooling 60, 61 which crimps the partially inserted terminals onto the wires. The leading housing is severed from the strip, and the crimped terminal is inserted into the housing by insertion means shown at 65. It will be understood that the crimping, strip severing, and inserting operations can be carried out at two or more stations if desired. It will also be understood that the individual housings with the partially inserted terminals contained therein can be individually removed from the carrier strip and the terminals crimped onto the ends of wires by means of a suitable hand tool.

A salient advantage of the invention is that the insulated terminations 2 can be produced directly from the strip of housings 8 and any desired type of electrical connection can be used between the end of the wire and the terminal. As mentioned previously, the type of crimp shown in the drawing, which is made by curling the U-shaped crimp portions 24, 26 of the terminal onto the wire 6 requires extremely high forces and it is usually not practical to pre-insulate terminals if this type of crimp is being used. Since the terminal is crimped onto the wire while the crimp portions 24, 26 are outside of the housings, the crimping operation can be carried out in any desired manner and there is no limitation on the crimping forces employed for the reason that the plastic housings 8 are not subjected to the crimping forces.

FIG. 6 shows a multi-contact connector in accordance with the invention comprising a plurality of individual housings in side-by-side relationship connected by a carrier strip as previously described. However, the carrier strip 44' extends between the sidewalls of an adjacent housing and does not project beyond the mating ends of the housings. It will also be noted that the housings are relatively close together in this embodiment. A connector of the type shown in FIG. 5 can be produced from a reel of housings by simple cutting off a length of the strip containing the desired number of terminal positions. The terminals can be crimped onto the wires as previously described and the finished connector can then be directly mated with a row of terminal tabs.

FIG. 7 shows an alternative embodiment of the invention in which the receptacle portion 10 of the terminal has a tongue 66 extending downwardly from its leading end. When the terminal is in its partially inserted condition, this tongue extends into an opening 70 in the floor of the housing cavity for retention purposes. The housing has a groove 76 which extends from its rearward end 34 forwardly for the accommodation of the tongue 66 and the groove is upwardly inclined at its right hand end as shown at 73. The opening 70 is enlarged at its lower end 71 on its left hand side so that during insertion of the terminal to its partially inserted condition, the portion 73 of the housing floor can flex downwardly to permit the tongue to snap into opening 70.

The terminal is moved to its fully inserted condition in the manner described above after it has been crimped onto a wire and after it is fully inserted, it is retained in the housing by a shoulder 72 provided by a boss 75. The shoulder is directed towards the mating face 32 of the housing. It will be noted that the top wall of the housing 68 is relatively thin in the vicinity of the shoulder 72 as shown at 80 so that this portion of the top wall can flex upwardly during movement of the terminal from its partially inserted position to its fully inserted position in which the shoulder 72 bears against the trailing end 74 of the receptacle portion 10 of the terminal. The terminal can be restrained against forward movement past the mating face of the housing by means of an additional tongue (not specifically shown) similar to the tongue 66 which would snap into the opening 70. Housings of the type shown at 68 would be manufactured as a continuous strip as previously described with reference to the embodiment of FIGS. 1–6.

What is claimed is:

1. A method of producing insulated terminals on the ends of wires comprising the steps of:

providing a continuous plastic strip of connector housings in side-by-side spaced-apart relationship, feeding said strip past a terminal insertion station and partially inserting an electrical terminal into each housing so that the crimp portion of each terminal is outside of its associated housing, winding said strip onto a reel, feeding said strip from said reel to a terminal applicator, crimping said terminals to wires as said strip is fed to said applicator, and inserting said terminals entirely into said housing so that the crimp portion of each terminal is contained within its respective housing.

2. A method as set forth in claim 1 including the step of severing the individual housings from said continuous plastic strip concomitantly with insertion of said terminals into said housings.

3. A method of manufacturing electrical leads of the type comprising a single terminal crimped onto the end of a single wire and an insulating housing in surrounding and enclosing relationship to said terminal, said method comprising the steps of:

producing a plastic strip comprising a continuous carrier strip having at spaced-apart intervals housing integral therewith which are dimensioned to receive one of said terminals in a partially inserted position and in a fully inserted position, feeding said strip past a terminal insertion station and partially inserting a terminal into each of said housings so that the crimp portion of each terminal is outside of the housing, winding said strip onto a reel, feeding said strip from said reel to a terminal applicator and positioning said crimp portion of each terminal between the crimping dies of said applicator, crimping each of said terminals onto a wire at said applicator and thereafter moving each terminal to its fully inserted position so that said terminal is entirely contained in its housing.

4. The method set forth in claim 3 in which said terminals are moved into said housings at said crimping station.

* * * * *